US009997340B2

(12) United States Patent
Hager et al.

(10) Patent No.: US 9,997,340 B2
(45) Date of Patent: Jun. 12, 2018

(54) RF-ONLY DETECTION SCHEME AND SIMULTANEOUS DETECTION OF MULTIPLE IONS

(71) Applicant: DH Technologies Development PTE Ltd., Singapore (SG)

(72) Inventors: James Hager, Mississauga (CA); Christopher M Lock, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days. days.

(21) Appl. No.: 15/021,362

(22) PCT Filed: Sep. 12, 2014

(86) PCT No.: PCT/IB2014/001821

§ 371 (c)(1),
(2) Date: Mar. 11, 2016

(87) PCT Pub. No.: WO2015/036848

PCT Pub. Date: Mar. 19, 2015

(65) Prior Publication Data

US 2016/0225593 A1 Aug. 4, 2016

Related U.S. Application Data

(60) Provisional application No. 61/877,574, filed on Sep. 13, 2013.

(51) Int. Cl.

| | |
|---|---|
| ***H01J 49/42*** | (2006.01) |
| ***H01J 49/00*** | (2006.01) |
| ***H01J 49/06*** | (2006.01) |

(52) U.S. Cl.

CPC ..... *H01J 49/0036* (2013.01); *H01J 49/063* (2013.01); *H01J 49/4215* (2013.01); *H01J 49/005* (2013.01)

(58) Field of Classification Search

CPC .. H01J 49/0036; H01J 49/005; H01J 49/4215; H01J 49/063

See application file for complete search history.

(56) References Cited

U.S. PATENT DOCUMENTS 5,998,787 A * 12/1999 Hager ..... H01J 49/427 250/282
6,703,607 B2 * 3/2004 Stott ..... H01J 49/4225 250/281

(Continued)

FOREIGN PATENT DOCUMENTS

WO WO2013038211 A1 3/2013

OTHER PUBLICATIONS

International Search Report and Written Opinion for PCT/IB2014/001821 dated Jan. 23, 2015.

*Primary Examiner* — Wyatt Stoffa

(57) ABSTRACT

A mass spectrometer apparatus and method for conducting simultaneous MS/MS analysis including: a device to select a precursor ion having a specified m/z; a gas-filled collision cell; an RF-only multipole mass spectrometer, the mass spectrometer having a generator attached thereto for generating at least two auxiliary AC fields in the RF-only multipole mass spectrometer; a gate for providing a repulsive DC or AC barrier downstream to an exit of the RF-only multipole mass spectrometer; an ion detection system situated downstream from the DC or AC barrier for measuring an ion current derived from ions that overcome the repulsive barrier. The mass spectrometer may also be configured so that each of the auxiliary AC fields are generated by the introduction of individual auxiliary AC frequencies and each frequency is amplitude modulated at a unique frequency.

10 Claims, 8 Drawing Sheets

(56) References Cited

U.S. PATENT DOCUMENTS 7,034,292 B1 4/2006 Whitehouse et al.
7,045,797 B2 * 5/2006 Sudakov ..... H01J 49/4215 250/282
2002/0175279 A1 * 11/2002 Hager ..... H01J 49/4225 250/282
2003/0222210 A1 * 12/2003 Stott ..... H01J 49/4225 250/282
2004/0183005 A1 * 9/2004 Hager ..... H01J 49/4225 250/282
2004/0238734 A1 * 12/2004 Hager ..... H01J 49/067 250/281
2005/0098719 A1 * 5/2005 Thomson ..... H01J 49/0081 250/288
2006/0243903 A1 11/2006 Wang et al.
2007/0295900 A1 * 12/2007 Konenkov ..... H01J 49/4215 250/283
2008/0265155 A1 * 10/2008 Kovtoun ..... H01J 49/427 250/292
2009/0032697 A1 * 2/2009 Sugiyama ..... H01J 49/0045 250/282
2009/0179149 A1 * 7/2009 Sugiyama ..... H01J 49/0045 250/282
2009/0194688 A1 * 8/2009 Bateman ..... H01J 49/4215 250/292
2009/0294641 A1 12/2009 Konicek et al.
2014/0284469 A1 * 9/2014 Langridge ..... H01J 49/063 250/282
2015/0060658 A1 * 3/2015 Langridge ..... H01J 49/063 250/282
2015/0102215 A1 * 4/2015 Jung ..... H01J 49/005 250/282
2016/0027633 A1 * 1/2016 Jung ..... H01J 49/005 250/292

* cited by examiner

RF-ONLY DETECTION SCHEME AND SIMULTANEOUS DETECTION OF MULTIPLE IONS

RELATED APPLICATIONS

This application claims the benefit of priority from U.S. Provisional Application Ser. No. 61/877,574, filed on Sep. 13, 2013, the contents of which are incorporated by reference.

FIELD

The teachings herein described pertain to an apparatus and method for an RF only detection scheme and/or the simultaneous detection of multiple ions in a mass spectrometer.

BACKGROUND

Quadrupole mass spectrometers are known in the art and typically operate as narrow band pass filters by appropriate selection and application of radiofrequency (RF) and direct current (DC) voltages to the quadrupole electrodes that correspond to the Mathieu a and q values near the apex of the first stability region. Quadrupoles typically comprises two pairs of cylindrical (preferably hyperbolic) rods that are arranged symmetrically about a central axis and oriented to receive ions that enter from one end. Ions that exit from the other end may be detected or further manipulated. A and q are obtained from the known equations $$q = \frac{4eV}{r_0^2\Omega^2 m}$$

$$a = \frac{8eU}{r_0^2\Omega^2 m}$$

Where U is the DC voltage, V is the RF Voltage, $r_0$ is the radius of the inscribed circle between the rods, Ω is the angular frequency (radians/second) of the drive voltage and m is the mass of the ion.

Quadrupoles can also operate in RF-only mode, commonly referred to as transmission mode RF-only mass spectrometers in which no resolving DC voltage is applied to the quadrupole electrodes as discussed for example in U.S. Pat. No. 4,090,075, incorporated herein by reference. Such RF-only mass spectrometers are known to provide unit resolution mass spectral peaks with poor quality quadrupoles [J. W. Hager, Rapid Communications in Mass Spectrometry, 13, 740(1999), herein incorporated by reference]. This state of operation corresponds to that where the Mathieu a-parameter is set to 0 and the quadrupole operates as a broad band, high pass filter. As the RF voltage is increased, near 100% transmission of an ion of particular mass is observed until the high Mathieu q-parameter cutoff at 0.907 is reached. At this point, ions become unstable and gain significant radial amplitude until they are removed by either contacting the electrodes or being ejected. At the exit of quadrupole devices, fringing fields are present that can convert radial energy of ions into axial energy. Accordingly, ions having large radial displacements within the fringing fields receive a proportionately greater kinetic energy boost from this conversion than those with small radial displacements. A downstream repulsive DC or AC barrier can be used to discriminate between the kinetic energy of the radially excited ions from the ions that have not been radially excited.

Transmission mode RF-only mass spectrometers have multiplexing advantages over conventional RF/DC quadrupole filters since ions at multiple m/z values can be transmitted simultaneously at unit resolution. This yields a multiplexing advantage to the extent that the same signal-to-noise in the RF-only device can be achieved which can increase the duty cycle of an instrument.

In addition to radial excitation that comes from operation at or near a stability boundary, such as that at a=0, q=0.907, radial excitation can also occur through interaction with an auxiliary AC field as described in U.S. Pat. No. 6,114,691, herein incorporated by reference. However, it is important that the background ion signal be discriminated from the radially excited ion signal to generate acceptable signal-to-noise in these transmission RF-only quadrupole mass spectrometers. Further background is described in U.S. Pat. No. 5,998,787, U.S. Pat. No. 6,028,308 and U.S. Pat. No. 6,194,717, herein incorporated by reference.

One of the difficulties with transmission mode RF-only mass selection is the problem of discrimination against background signal due to the presence of high-energy ions. This can be alleviated by the addition of an auxiliary excitation which can aid in imparting higher kinetic energies to ions that are resonant with the excitation frequency and increase the amount of associated kinetic energy relative to the background ion signal. However, this introduces a problem of distinguishing between the signal from a particular ion that would occur when in resonance with the auxiliary AC field and signal that arises from the usage at other instability boundaries, such as a=0, q=0.907. An example of this is shown in FIG. 4, in which the product ion spectrum of the protonated reserpine ion having an m/z ratio of 609 Da has been obtained in a tandem quadrupole mass spectrometer. In this setup, Q1 was operated as a standard RF/DC quadrupole in low resolution mode selecting the m/z 609 Da precursor ion and Q3 as an RF-only quadrupole mass spectrometer with auxiliary dipolar excitation at 616 kHz (drive RF=1.5 Mhz) where Q3 was scanned at 667 amu/sec. The upper spectrum of FIG. 4 shows the Q3 output of the tandem mass spectrometer over a broad range, the middle trace shows an expansion of the parent ion region and the bottom spectrum expands the vertical scale to show an additional feature at a m/z of 635 Da. The two RF-only signals in the bottom spectrum are both from residual precursor ions: one at m/z 609 which originates from resonance excitation using a 616 kHz auxiliary AC field and one that is present at m/z 635 derived from the a=0, q=0.907 instability boundary. The use of the transmission-mode RF-only quadrupole with auxiliary excitation therefore presents the possibility of contribution to the detected signal from ions at slightly smaller m/z values as well as excitation at the a=0, q=0.907 stability boundary. This reduces selectivity and signal-to-noise of the device. One can eliminate this difficulty in scanning mode by simply removing the auxiliary excitation and obtaining the mass spectrum at the a=0, q=0.907 stability boundary. However, this also eliminates the possibility of multiplexing in Selected Ion Monitoring (SIM) or Multiple Reaction Monitoring (MRM) modes, since for the use of these transmission-mode RF-only quadrupoles, there will always be a contribution to the transmitted ion signal from lower m/z ions at the a=0, q=0.907 stability boundary.

SUMMARY

In various embodiments, the use of a transmission mode RF-only quadrupole mass spectrometer with several auxiliary excitation frequencies that match up with the predetermined (product) ion secular frequencies allows for the transmission of multiple ions to the detector.

In some embodiments, each of the auxiliary fields can be amplitude modulated at a unique frequency that is detectable with phase sensitive electronics. With each ion signal being modulated at a unique frequency, the individual contribution of each ion signal to the total intensity can therefore be determined. This can allow for the both the determination of the sum of all intensities for all of the targeted ions for high sensitivity detection, as well as the relative intensity ratios for the ions for confirmation information.

In some embodiments, the teachings herein provide for a method in which an RF-only quadrupole mass spectrometer can be utilized with increasing signal to noise ratio and better sensitivity.

In some embodiments, the teachings herein provide for a method of utilizing an RF-only quadrupole in a manner in which multiple ions can be transmitted, detected and distinguished.

In some embodiments, the teachings herein provide for a method of distinguishing between an ion signal from a resonant process and ion signals not arising from a resonant process which includes the use of an auxiliary RF voltage and the addition of a degree of modulation to the resonantly excited ion signal.

In some embodiments, the teachings herein provide for an RF-only detection scheme that can discriminate against background ion signal that is an issue in RF-only mass spectrometers.

In another aspect, the teachings provide for a method of conducting SIM and MRM analysis in a multiplexing mode.

In various embodiments, a mass spectrometer apparatus for conducting simultaneous MS/MS analysis is disclosed comprising: a device to select a precursor ion having a specified m/z; a gas-filled collision cell; an RF-only multipole mass spectrometer, the mass spectrometer having a generator attached thereto that is configured to generate at least two auxiliary AC fields in the RF-only multipole mass spectrometer; a gate configured to provide a repulsive DC or AC barrier downstream to an exit of the RF-only multipole mass spectrometer; and an ion detection system situated downstream from the DC or AC barrier for measuring an ion current derived from ions that overcome the repulsive barrier.

In some embodiments, the device to select the precursor ion is a transmission mode RF/DC quadrupole mass spectrometer.

In some embodiments, the RF-only multipole mass spectrometer is a quadrupole.

In some embodiments, each of the at least two auxiliary AC fields are generated by the introduction of individual auxilliary AC frequencies and each AC frequency is amplitude modulated at a unique frequency so that the ion signal obtained from the ion detection system is also modulated at the same unique frequency.

In some embodiments, the ion detection system is configured to use a frequency-dependent detection scheme that is tuned to each of the unique frequencies.

In some embodiments, the frequency-dependent detection scheme is a lock-in amplifier. In various embodiments, a method of acquiring simultaneous multiple reaction monitoring measurements is disclosed comprising: selection of a precursor ion; fragmentation of the precursor ion in a gas-filled collision cell by axial acceleration to form two or more different known fragment ions; setting the RF voltage on rods of an RF only mass spectrometer such that all of the known fragment ions that pass through the RF only mass spectrometer are stable throughout the length of the RF only mass spectrometer; providing a repulsive barrier downstream to an exit of the RF only mass spectrometer; applying two or more auxiliary AC signals to rods of the RF only mass spectrometer so as to generate two or more auxiliary AC fields, wherein each of the two or more auxiliary AC fields are in resonance with at least one of the two or more different known fragment ions so that each of the two or more different known fragment ions will gain energy in an exit fringing field of the RF only mass spectrometer and surmount the repulsive barrier; passing the known fragment ions through said RF only mass spectrometer; and detecting the ion current that emerges over the repulsive barrier.

In some embodiments, each of the two or more auxiliary AC signals are amplitude modulated at a specified frequency so that the ion current detected is modulated at the same specified frequency. In some embodiments, each of the two or more the auxiliary AC signals are amplitude modulated at different frequencies that are not multiples of each other.

In some embodiments, a frequency-dependent detection system is used to detect the ion current.

In some embodiments, the ion current from each of the fragment ions is deconvolved from the total ion current using the frequency-dependent detection system.

In some embodiments, the frequency-dependent detection system is a lock-in amplifier.

In some embodiments, the repulsive barrier is an AC or DC repulsive barrier.

In various embodiments, a method of improving the signal to noise ratio in a quadrupole mass spectrometer that uses RF voltages is disclosed, the method comprising: amplitude modulating the RF voltage, that is used to transmit ions through said mass spectrometer, at a unique frequency; generating an ion signal by detecting ions that pass through said quadrupole, and performing phase sensitive analysis of said ion signal.

In some embodiments, a lock-in amplifier is used.

DETAILED DESCRIPTION OF EMBODIMENTS

While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

Figure 1:
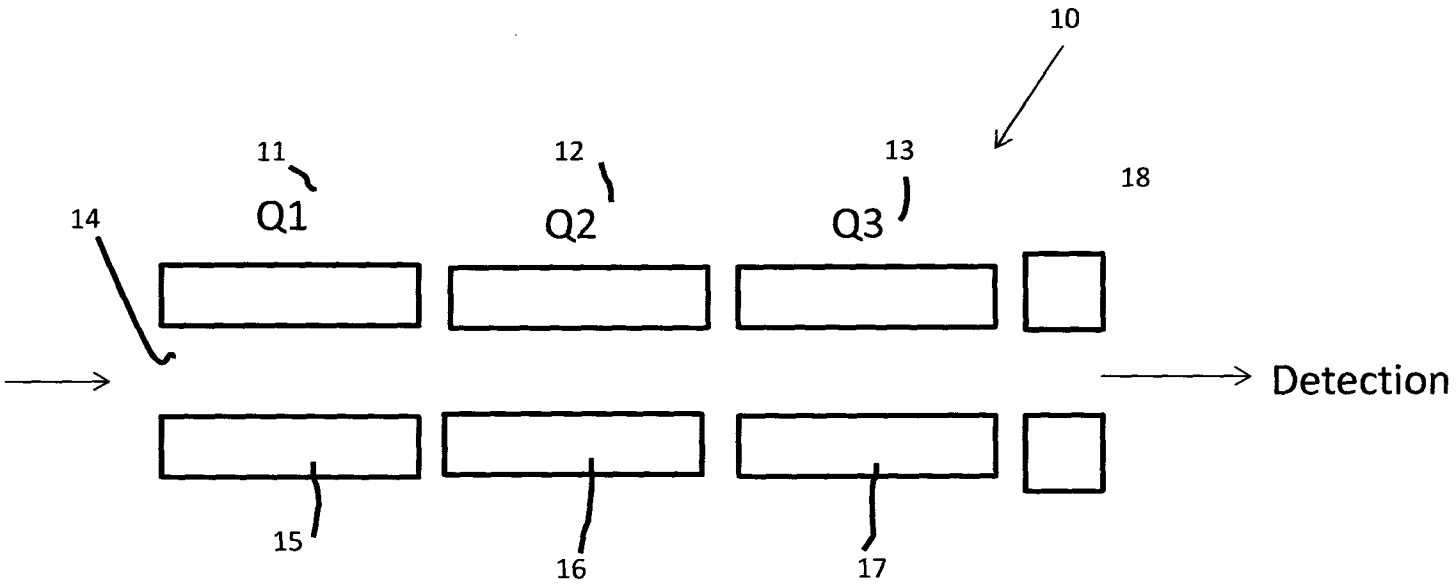
FIG. 1 depicts an exemplary tandem mass spectrometry system

Referring to FIG. 1, an exemplary tandem mass spectrometer system 10 which comprises three quadrupole mass spectrometers (11, 12, 13). As is known in the art, the three quadrupoles are referred to as Q1 11, Q2 12 and Q3 13, respectively. In the first quadrupole, Q1 11, ions are introduced into the entrance 14. Ions may be made from molecules using methods commonly known in the art and may include electron impact, chemical ionization, desorption chemical ionization, fast atom bombardment, electrospray ionization, matrix-assisted laser desorption/ionization (MALDI). Depending on the nature of the original molecule and the conditions used in ionization, the ions formed may be positive or negative and may be singly charged or multiply charged. Q1 11 is connected to radio-frequency and direct current voltages which are controlled using a suitable controller and voltage sources (not shown). The operation involves the typical operation of Q1 11 in a tandem based quadrupole analysis as a narrow band-pass filter. By selecting appropriate RF and DC voltages to be applied to the quadrupole rods in Q1 11, only ions having a certain m/z ratios are allowed to travel the length of the Q1 11 (i.e., are stable) and to subsequently enter Q2 12. All other ions having other m/z ratios are either ejected radially and/or neutralized by contacting the quadrupole rods 15. In this way, Q1 is used primarily as a mass filter for selecting precursor ions having a particular m/z ratio to be further processed or analyzed in subsequent quadrupole devices Q2 12 and Q3 13.

Upon exiting Q1 11 along the axial path, the selected ions having a particular m/z ratio then enter Q2 12 where they are induced to undergo fragmentation via collision induced dissociation (CID). This typically involves the acceleration of the selected molecular ions from Q1 using an electric potential introduced via the use of suitable voltages applied to the quadrupole rods 16 of Q2 so that they collide with neutral gaseous molecules, typically used are nitrogen or helium, though others may be utilized. Upon collision with the neutral molecule, the kinetic energy from the accelerated molecular ions causes bond breakage and fragmentation of the molecular ions into smaller fragments. Q2 12 is commonly known as a collision cell. These fragments are then directed towards the exit of Q2 12 where they are passed onto Q3 13.

Q3 13 is operated as an RF only quadrupole mass spectrometer. This may be a quadupole mass spectrometer that only contains leads connected to an RF voltage source or this may be a conventional RF/DC quadrupole mass spectrometer which is being operated in transparent mode, (i.e., with no resolving DC voltage applied). RF fields within Q3 are generated by the use of a primary RF voltage and one or more auxiliary RF voltages that are generated by a generator. The primary RF voltage which is electrically connected to the Q3 quadrupoles generates an RF field in which a selected range of ion masses are stable and therefore pass through the quadrupoles 17 and other ion masses are rejected by becoming unstable and exiting radially from the quadrupoles 17 and/or contacting the rods. Each of the one of more auxiliary RF voltages are generated by a suitably configured source that is electrically connected to the Q3 quadrupoles 17 to generate a suitable auxiliary RF field which is based on a selected Mathieu's q-value. Each of the generated auxiliary RF fields can excite selected ions which are in resonance with the auxiliary RF field and cause selected ions to experience radial excursions of amplitude, that are however insufficient to strike the quadrupole rods 17, so that the selected ions are transmitted through the quadrupole rods 17. In this manner, Q3 13 operates as a broad band, high pass filter. By using multiple auxiliary RF voltages/fields, it is possible to transmit more than one type of selected ion simultaneously through Q3 13.

At the exit of Q3 13, fringing fields are present that can convert the radial energy present in ions into axial energy. As a result of this conversion, ions having large radial displacements travelling through Q3 13 will receive a proportionately greater kinetic energy boost as they travel through the fringing fields than those with small radial displacements. The radial displacements of specific ions can be changed by the use of the auxiliary RF fields, but certain radial displacements may already exist based on the nature of the ions involved. A repulsive DC or AC barrier in the form of gate electrodes 18 that is situated at the exit of Q3 13 or downstream to the exit of Q3 13 can be used to discriminate between the kinetic energy of the radially excited ions and the ions that have not been radially excited. Setting and configuring the DC or AC barrier to a certain threshold, only ions having sufficient energy to overcome the barrier will pass through the barrier to be eventually detected. As would be understood in the art, the repulsive DC or AC barrier can also be provided for by other means such as filtering electrodes or grided lenses. With whatever method, the barrier is connected to a suitable DC or AC voltage source and controller to allow for the generation of the barrier.

Figure 2:
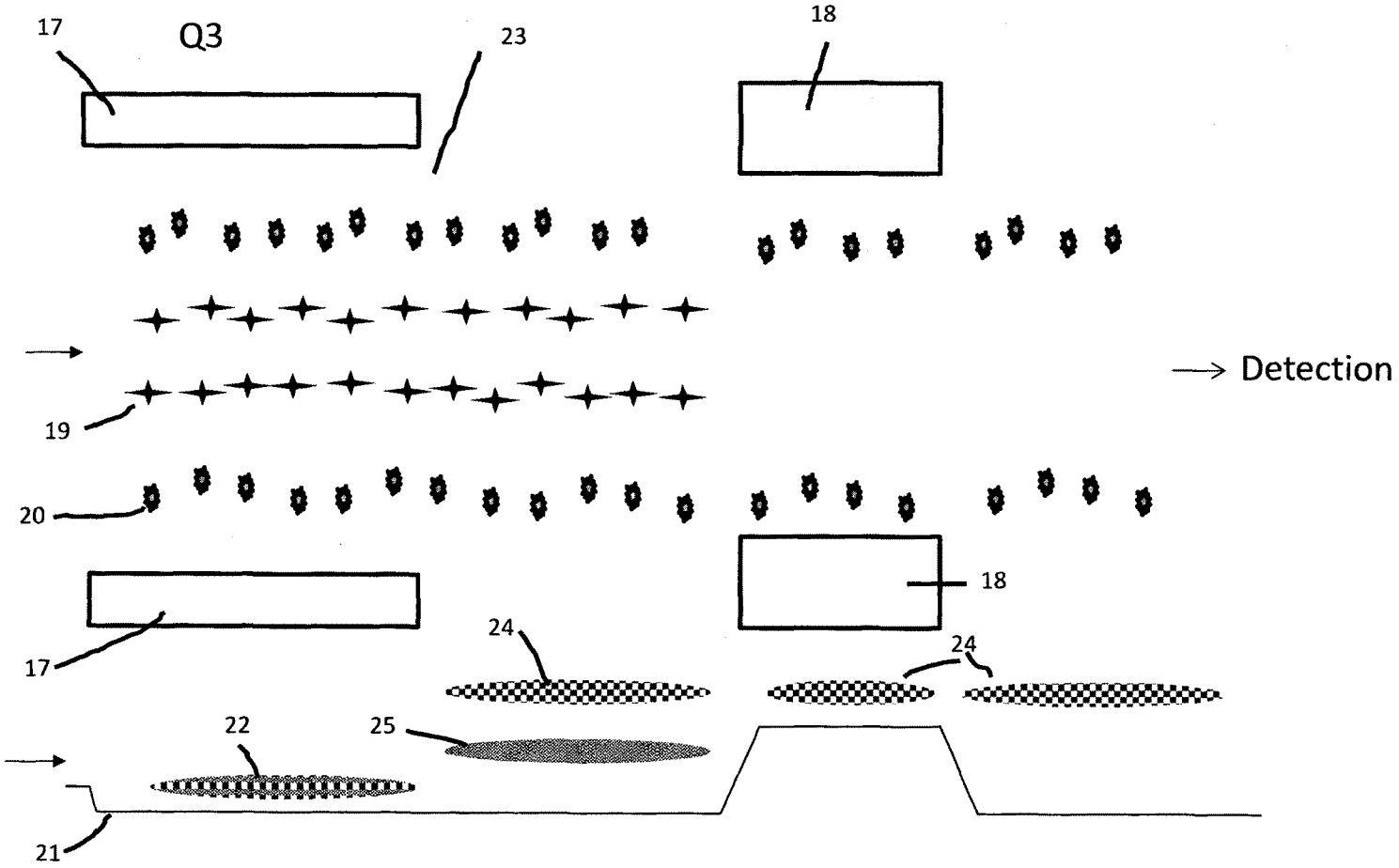
FIG. 2 depicts an exemplary view of the exit of Q3

This phenomenon is more easily visualized in FIG. 2 which depicts a schematic view of the exit of Q3 13 and its operation in conjunction with a downstream repulsive DC or AC barrier generated by corresponding gate electrodes 18. A spatial energy plot 21 for traversal of ions from left to right is shown at the bottom of FIG. 2 and is represented by a solid line. In this example, two types of ion fragments (19, 20) pass through Q3 13. Due the differences in properties between the two ions 19, 20 and the interaction with RF fields present, one set of ions 20 demonstrates a higher radial displacement from the centerline of the axis of the quadrupoles 17 than the other. The two types of ions (19, 20) have kinetic energy 22 that is similar during their traversal through Q3 13. Upon exiting the quadrupole Q3 13, the ions (19, 20) interact with fringe fields that exist at the exit 23 and gain some additional kinetic energy as a result of the conversion from radial energy to axial energy. The kinetic energy after the exit of Q3 13 will therefore be higher for one type of fragment ion then the other. In FIG. 2, ion 20 that had a larger radial displacement than ion 19 in Q3 13 will have an energy 24 that is higher than the corresponding energy 25 of ions 19 after the ions (19, 20) interact with the fringe field. The ions than traverse to the repulsive DC or AC barrier which can be a series of electrodes that is set so as to allow only ions meeting a certain minimum energy threshold to pass through and on to subsequent detection.

The repulsive DC or AC barrier is any barrier that can discriminate between various ions based on their kinetic energy. Preferably, this barrier is in the form of an electrode gate 18 which is able to generate a DC or AC field. This field prevents movement of ions not having a certain minimum threshold energy through the field. In FIG. 2, the threshold energy is set such that only ions 20 having energy 24 are able to pass through the gate 18 and on to detection.

Located downstream from the barrier, an ion detection system is present. The ion detection system is preferably any system capable of detecting an ion such as for example, an electrode. The ion detection system can preferably convert the detected presence of ions into an ion current.

Figure 3:
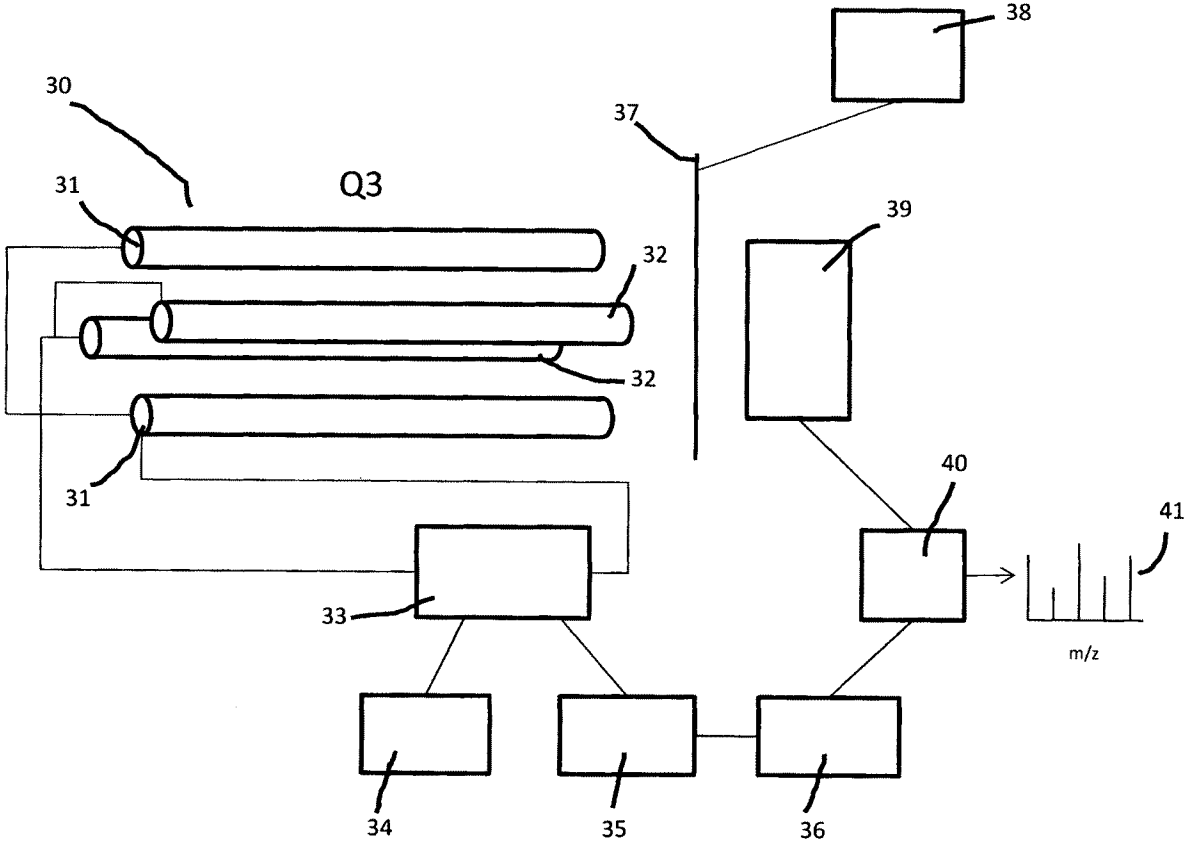
FIG. 3 depicts a schematic outlining the operation of Q3 in one embodiment
Figure 4:
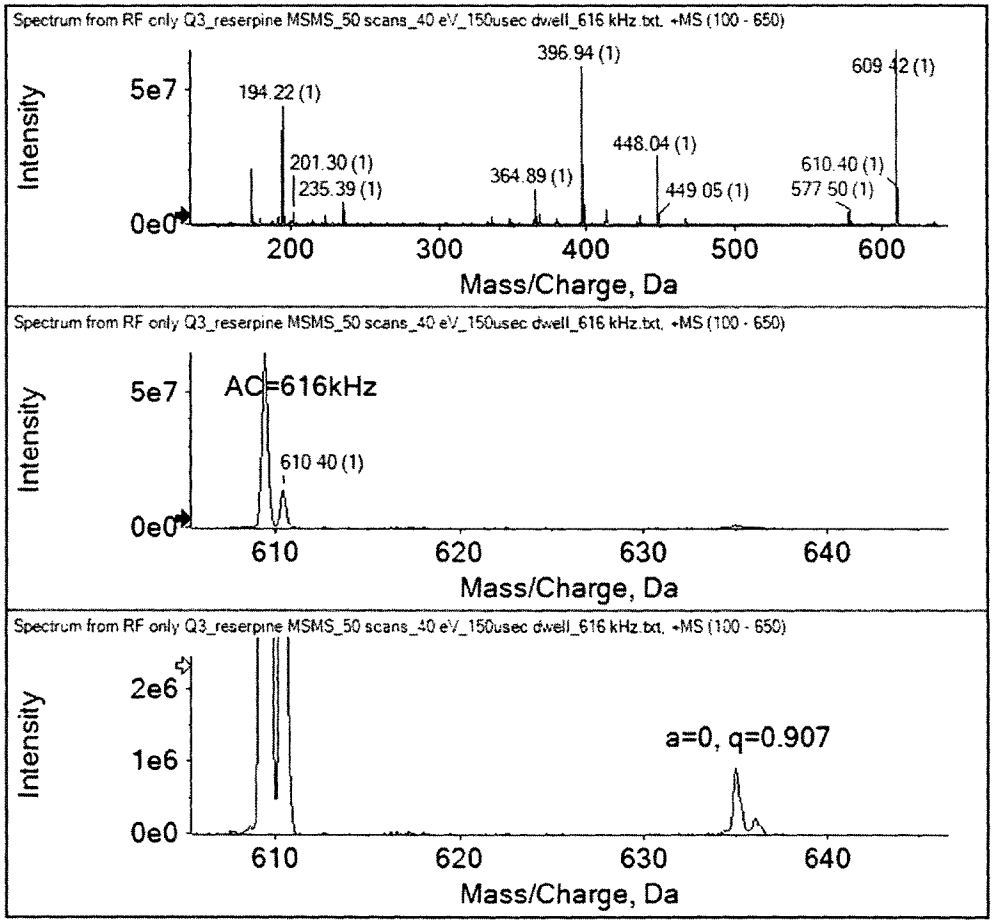
FIG. 4 depicts RF-only mass spectrum of reserpine fragment ions.

Now referring to FIG. 3, a schematic and flow sheet of the operation of Q3 in one embodiment of the present teachings is depicted. A quadrupole 30, having 2 pairs of rods oriented in a conventional quadrupole arrangement is operated as an RF-only quadrupole. Each of the pairs of rods 31, 32 is electrically connected to RF voltage generator 33 which generates RF fields in the quadrupole 30 that is applied 180-degrees out of phase to each pole pair. The RF voltage generator 33 is composed of a primary RF generator 34 which generates a primary RF voltage and an auxiliary RF generator 35 which generates two or more auxilliary RF voltages. The auxiliary RF generator 35 is connected to controller 36 which amplitude modulates each of the auxiliary RF voltages. Situated downstream from the exit of the quadrupole 30 is located a grid lens 37 that generates either an AC or DC repulsive field. This grid lens 37 is electrically connected to an AC or DC source 38. Situated downstream from the grid lens 37 is an ion detector electrode 39 which detects ions which pass through the quadrupole and have sufficient kinetic energy that surpasses a threshold energy level of the repulsive field generated by the grid lens 37. The ion detector 39 generates an ion current from ions that impinge upon it and the corresponding signal is passed to deconvoluter unit 40. The deconvoluter unit 40 is connected to controller 36 which enables the deconvoluter unit 40 to be aware of the amplitude modulation frequencies used to modulate the original ion signals. With this, the deconvoluter unit 40 is able to deconvolute the ion signal by separating individual ion currents that relate to a specific fragment ions from the total ion current. The deconvolution unit 40 then is able to generate a mass spectra 41 from the deconvoluted signal. As would be appreciated, several of the generators and/or controllers, etc. can be combined into a single device, such as for example, the use of a lock-in amplifier.

The use of multiple auxiliary excitation frequencies in the quadrupole type configuration path and ion path have the capability of imparting dipolar excitation in the auxiliary field. This allows significant multiplexing advantages to be achieved since multiple amplitude modulated AC fields can be applied in Q3 simultaneously, which allows the signal from many of the fragmented ions to be transmitted through simultaneously and detected.

This offers significant duty cycle improvement as multiplexing operations to quantify expected ions can be used to optimize device usage. Such a quadrupole operation method can be implemented using a control system. Energy discrimination can be implemented using a gridded exit lens as used in some quadrupole systems (such as in ABSCiex QTRAP® type systems). In addition, each of the one or more auxiliary resonance fields can be amplitude modulated at a specific frequency to detect only the ion signal at that frequency using a suitable phase sensitive detector, such as a lock-in amplifier.

While two or more auxiliary AC fields can be used, any number of AC fields may be utilized that correspond to the number of detected ions desired to be detected. Each of these auxiliary AC fields can be amplitude modulated at a unique frequency so that the resulting ion current signal for a desired detected ion is also modulated at that specific frequency. Preferably, it is desirable that the unique frequencies used to modulate the AC fields not be multiples of one another. It is also desirable that the auxiliary AC fields be modulated at modulation depth of 1. Lower values of the modulation depth will provide signal-to-noise benefits, but only to the degree that the AC field is modulated.

Figure 5:
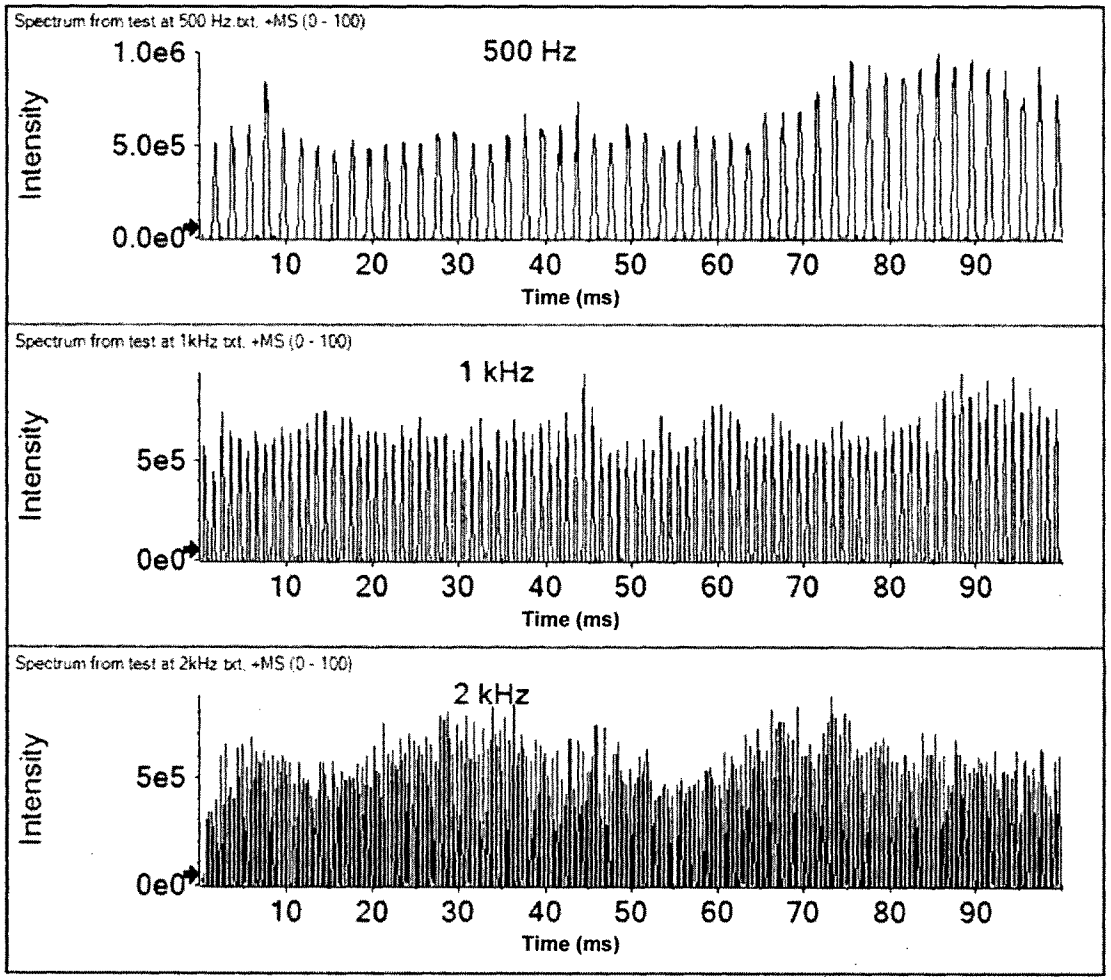
FIG. 5 depicts amplitude modulated RF-only MRM signals for 609→195 reserpine transition at 0.5, 1.0 and 2.0 kHz amplitude modulation conditions.
Figure 6:
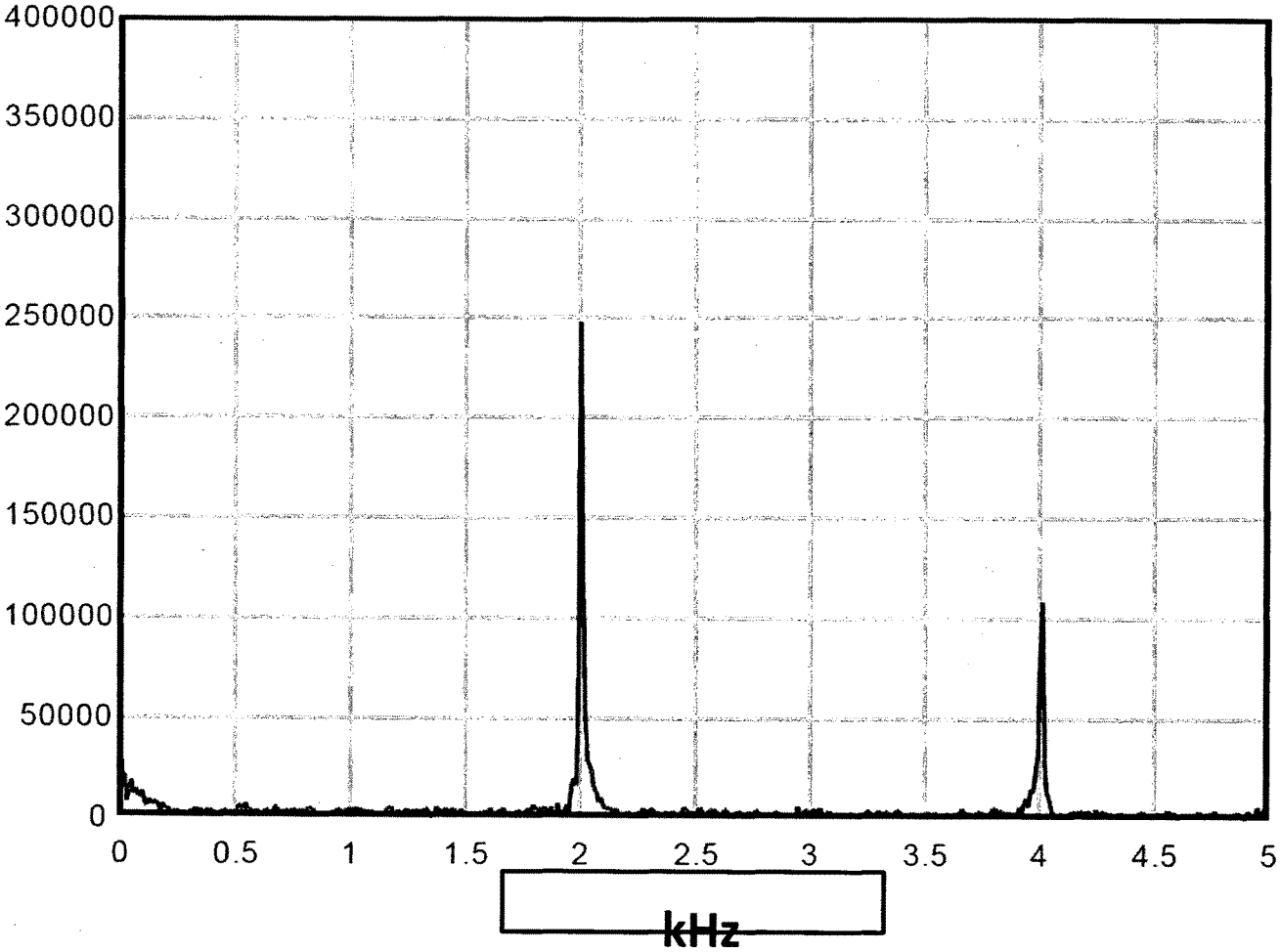
FIG. 6 depicts a fast Fourier transform spectra of the bottom trace of FIG. 4.

FIG. 5 shows three Multiple Reaction Monitoring (MRM) 609→195 traces with RF-only product ion detection at different amplitude modulation frequencies of 500 Hz, 1 kHz and 2 KHz of the auxilliary fields used in the quadrupole. As is evident, the detected ion is present at the same modulation frequency, however any continuum background signal from higher kinetic energy background ions or other species transmitted at the Mathieu values of a=0, q=0.907 will not be modulated. By differentiating between modulated and unmodulated detection, signal attributable to only the target ion can be detected. This frequency detection can be achieved by using phase sensitive detection, such as for example, the use of a lock-in amplifier, and/or Fourier transform analysis which can be used to effectively enhance the signal-to-noise signal. FIG. 6 depicts a fast Fourier transform analysis of the bottom trace of FIG. 5 showing the amplitude modulation frequency of 2 kHz and the 4 kHz overtone.

In other embodiments, Q2 may be replaced with any other suitable device capable of inducing fragmentation. In addition, other devices capable of inducing other types of fragmentation can also be used which include devices which are capable of implementing Surface Induced Dissociation, Electron Transfer Dissociation, Electron Capture Dissociation, Electron Ionisation Dissociation, Electron Collision or Impact Dissociation, a Photo Induced Dissociation, Laser Induced Dissociation, infrared radiation induced dissociation, ultraviolet radiation induced dissociation. Other devices can include the use of an in-source fragmentation device, an in-source Collision Induced Dissociation fragmentation device, a thermal or temperature source fragmentation device, an electric field induced fragmentation device, a magnetic field induced fragmentation device, an enzyme digestion or enzyme degradation fragmentation device, an ion-ion reaction fragmentation device, an ion-molecule reaction fragmentation device, an ion-atom reaction fragmentation device, an ion-metastable ion reaction fragmentation device, an ion-metastable molecule reaction fragmentation device, an ion-metastable atom reaction fragmentation device, an ion-ion reaction device for reacting ions to form adduct or product ions, an ion-molecule reaction device for reacting ions to form adduct or product ions, an ion-atom reaction device for reacting ions to form adduct or product ions, an ion-metastable ion reaction device for reacting ions to form adduct or product ions, an ion-metastable molecule reaction device for reacting ions to form adduct or product ions, and an ion-metastable atom reaction device for reacting ions to form adduct or product ions.

Figure 7:
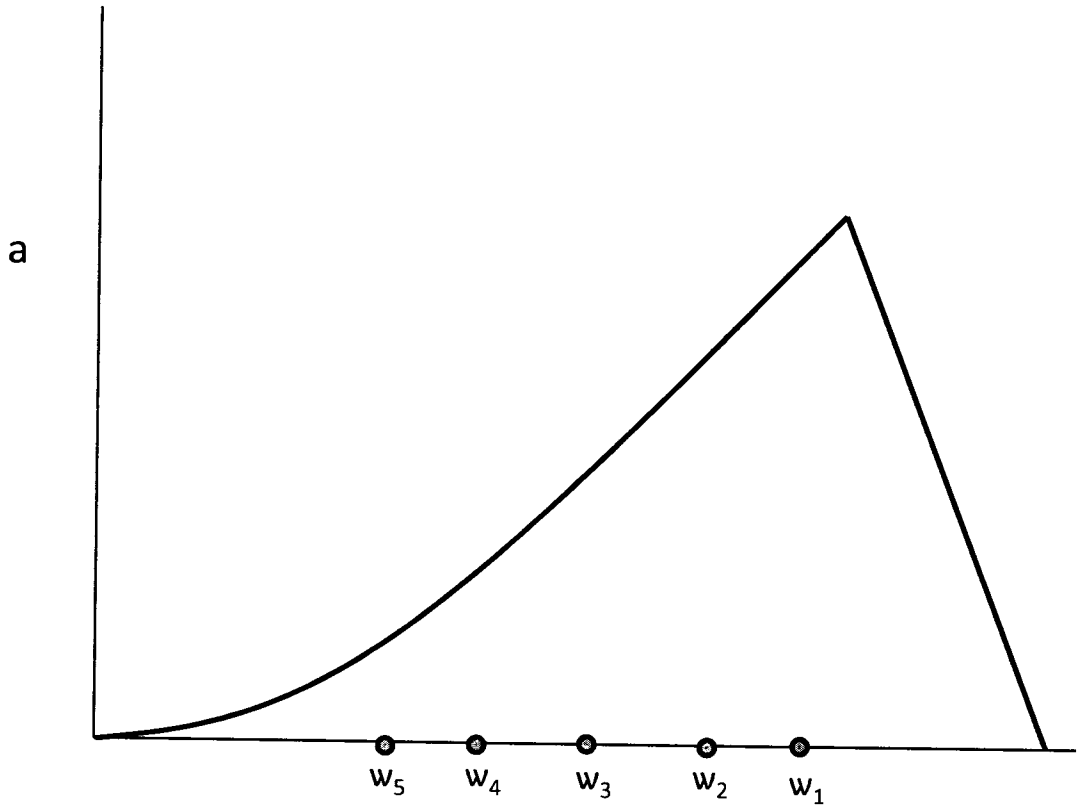
FIG. 7 depicts a Mathieu stability diagram and associated modulated amplitude frequencies
Figure 8:
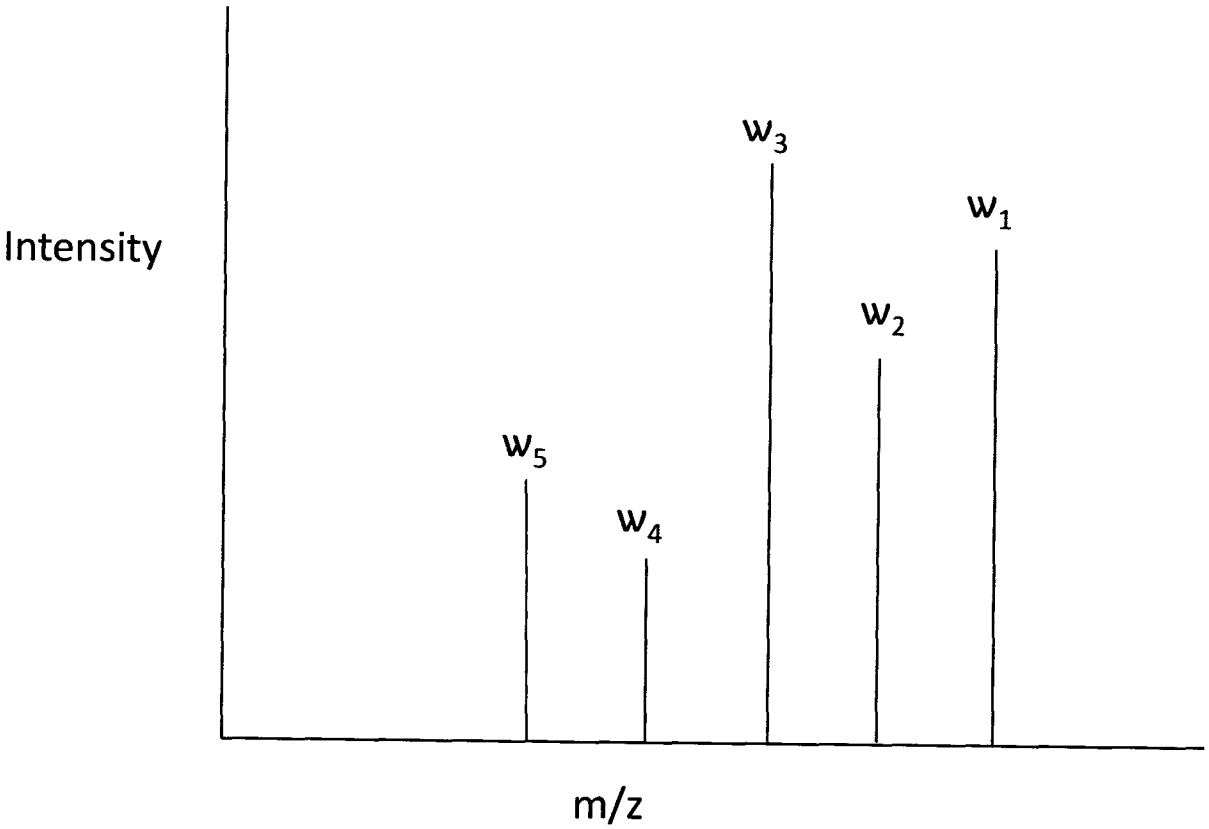
FIG. 8 depicts mass spectra where the modulated frequencies have been demodulated

Now referring to FIG. 7, there is depicted a Mathieu stability diagram. For a given ion from a series of five different known ion fragments with known m/z ratios, an associated q-value may be calculated for any of the five targeted ions. While five fragments have been selected here, any number of fragments can be chosen, limited in some embodiments, by the number of simultaneous auxiliary fields that can be generated by an RF voltage controller. For each of the five targeted ions, an appropriate and unique auxiliary RF frequency is chosen to be applied to the Q3 electrodes so as to allow the ion to be stable in the quadrupole Q3, depicted in FIG. 7 as w1, w2, w3, w4 and w5. This allows the transmission of all five of the targeted ions through Q3. To improve signal to noise and to distinguish between the various ions, each of the auxiliary RF voltages can be amplitude modulated with a unique frequency which causes the targeted signal for a particular selected ion to be modulated also. In this manner, multiple ion fragments with different m/z ratios can be detected simultaneously with improved signal to noise. The resulting signal containing information on the multiple ions is then deconvoluted to separate out the contributions of the individual ions. This can be accomplished by use of a phase sensitive analysis that is used to correlate data at a specific modulated frequency with the intensity of ion signal at a specified m/z ratio. These intensities may be plotted in a form to give the appropriate mass analysis spectrum, such as that depicted in FIG. 8. This phase sensitive analysis can be performed in real time or after the analysis.

All literature and similar material cited in this application, including, but not limited to, patents, patent applications, articles, books, treatises, and web pages, regardless of the format of such literature and similar materials, are expressly incorporated by reference in their entireties for all purposes. In the event that one or more of the incorporated literature and similar materials differs from or contradicts this application, including but not limited to defined terms, term usage, described techniques, or the like, this application controls.

The section headings used herein are for organizational purposes only and are not to be construed as limiting the subject matter described in any way.

While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The teachings should not be read as limited to the described order or elements unless stated to that effect. It should be understood that various changes in form and detail may be made without departing from the scope of the present teachings. By way of example, any of the disclosed method steps can be combined with any of the other disclosed steps to provide a method in accordance with various embodiments of the present teachings. Therefore, all embodiments that come within the scope and spirit of the present teachings and equivalents thereto are claimed.

The invention claimed is:

1. A mass spectrometer apparatus for conducting simultaneous MS/MS analysis comprising a transmission mode RF/DC quadrupole mass spectrometer to select a precursor ion having a specified m/z;

a gas-filled collision cell;

an RF-only multipole mass spectrometer, the mass spectrometer having a generator attached thereto that is configured to generate at least two auxiliary AC fields in the RF-only multipole mass spectrometer, wherein each of the at least two auxiliary AC fields are generated by the introduction of individual auxiliary AC frequencies and each auxiliary AC field is amplitude modulated at a unique frequency so that an ion current is also modulated at the same unique frequency;

a gate configured to provide a repulsive DC or AC barrier downstream to an exit of the RF-only multipole mass spectrometer; and an ion detection system situated downstream from the DC or AC barrier for measuring the ion current derived from ions that overcome the repulsive barrier.

2. The mass spectrometer apparatus of claim 1 wherein the RF-only multipole mass spectrometer is a quadrupole.

3. The mass spectrometer apparatus of claim 1 wherein the ion detection system is configured to use a frequency-dependent detection scheme that is tuned to each of the unique frequencies.

4. The mass spectrometer apparatus of claim 3 wherein the frequency-dependent detection scheme is a lock-in amplifier.

5. A method of acquiring simultaneous multiple reaction monitoring measurements comprising:

selection of a precursor ion;

fragmentation of the precursor ion in a gas-filled collision cell by axial acceleration to form two or more different known fragment ions;

setting the RF voltage on rods of an RF only mass spectrometer such that all of the known fragment ions that pass through the RF only mass spectrometer are stable throughout the length of the RF only mass spectrometer;

providing a repulsive barrier downstream to an exit of the RF only mass spectrometer; applying two or more auxiliary AC signals to rods of the RF only mass spectrometer so as to generate two or more auxiliary AC fields, wherein each of the two or more auxiliary AC signals are amplitude modulated at a specified frequency so that a detected ion current is modulated at the same specified frequency and wherein each of the two or more auxiliary AC fields are in resonance with at least one of the two or more different known fragment ions so that each of the two or more different known fragment ions will gain energy in an exit fringing field of the RF only mass spectrometer and surmount the repulsive barrier;

passing the known fragment ions through said RF only mass spectrometer; and detecting the ion current that emerges over the repulsive barrier.

6. The method of claim 5 wherein each of the two or more the auxiliary AC signals are amplitude modulated at different frequencies that are not multiples of each other.

7. The method of claim 6 wherein a frequency-dependent detection system is used to detect the ion current.

8. The method of claim 7 wherein the ion current from each of the fragment ions is deconvolved from the total ion current using the frequency-dependent detection system.

9. The method of claim 8 wherein the frequency-dependent detection system is a lock-in amplifier.

10. The method of claim 7 wherein the repulsive barrier is an AC or DC repulsive barrier.

* * * * *